United States Patent [19]

Jung

[11] Patent Number: 4,766,314

[45] Date of Patent: Aug. 23, 1988

[54] LENS ARRANGEMENT FOR THE FOCUSING OF ELECTRICALLY CHARGED PARTICLES, AND MASS SPECTROMETER WITH SUCH A LENS ARRANGEMENT

[75] Inventor: Gerhard Jung, Delmenhorst, Fed. Rep. of Germany

[73] Assignee: Finnigan MAT GmbH, Bremen, Fed. Rep. of Germany

[21] Appl. No.: 857,168

[22] Filed: Apr. 29, 1986

[30] Foreign Application Priority Data

Jun. 22, 1985 [DE] Fed. Rep. of Germany ..... 3522340

[51] Int. Cl.[4] ..... H01J 49/32

[52] U.S. Cl. ..... 250/296; 250/281; 250/396 R

[58] Field of Search ..... 250/296, 396 R, 281; 313/289, 292

[56] References Cited

U.S. PATENT DOCUMENTS

| | | | |
|---|---|---|---|
| 3,138,733 | 6/1964 | Smith | 313/289 |
| 3,585,384 | 6/1971 | Castaing et al. | 250/296 |
| 3,745,343 | 7/1973 | Halliday et al. | 250/396 R |
| 3,814,936 | 6/1974 | Green | 250/295 |
| 4,418,280 | 11/1983 | Matsuda | 250/296 |
| 4,638,160 | 1/1987 | Slodzian et al. | 250/296 |

OTHER PUBLICATIONS

"Design and Performance of an Energy-and Angle-Resolved Secondary Ion Mass Spectrometer," by R. A. Gibbs and N. Winograd, 1148-55, *Rev. Sci. Instrum.* 52(8), Aug. 1981.

*Primary Examiner*—Bruce C. Anderson
*Assistant Examiner*—Jack I. Berman
*Attorney, Agent, or Firm*—Flehr, Hohbach, Test, Albritton & Herbert

[57] ABSTRACT

A lens arrangement (30) for the focusing of a beam of electrically charged particles (24) in the beam path of imaging systems, more particularly in mass spectrometers (10), is indicated, the lens arrangement (30) being connected to an electrical voltage supply. The lens arrangement (30) is situated at the location or in the vicinity of the intermediate image (29) produced by the imaging system, and consists of a plurality of plates (32 to 35) disposed in succession, with aligned transmission apertures (38 to 41), the plates being connected to adjustable electrical voltages.

25 Claims, 3 Drawing Sheets

LENS ARRANGEMENT FOR THE FOCUSING OF ELECTRICALLY CHARGED PARTICLES, AND MASS SPECTROMETER WITH SUCH A LENS ARRANGEMENT

BACKGROUND OF THE INVENTION

The invention relates to a lens arrangement for the focusing of a beam of electrically charged particles in the beam path of imaging systems, more particularly in mass spectrometers for the examination of organic and inorganic substances, the lens arrangement is being connected to an electrical voltage supply. The invention further relates to a double-focus mass spectrometer, having an ion source, having an imaging system, consisting of a sector field magnet, an electrostatic analyser and other ion-optical elements in any sequence, and having a detector, positioned behind, for the particles of organic and inorganic substances to be examined.

With imaging systems for electrically charged particles, more particularly with double-focus mass spectrometers of the initially mentioned type, focusing problems arise in practice in circumstances in which it is desired to permit large aperture angles, large beam heights or large energy bandwidths in the electrically charged particle beam. This is because a part is played in these circumstances not only by the image defects of the first order, but also by the image defects of the second order, which are then no longer negligible. In these cases, both second order directional focusing and also second order energy focusing should accordingly be undertaken, in order that the mass resolution should not be impaired by image defects of the second order.

There are indeed analysers in such imaging systems, which permit a double focus of the second order, but the previously known special embodiments in practice involve certain disadvantages. For example, at a given radius of the sector field magnet, a very large electrostatic analyser must be used, so that overall large dimensions, a large magnet deflection angle and thus a costly magnet are required. Frequently, in such an arrangement only focusing in an axial direction of a coordinate system is possible, while focusing in the axial direction perpendicular thereto is not possible.

In order to explain the problem, the situation is first to be explained in general terms with reference to FIG. 6 of the drawing. An important quality feature of a mass spectrometer is its mass resolution, which is given by the following formula:

$$R = \frac{A_\gamma}{2(A_x \cdot S + \Delta)},$$

where the following symbols have been employed:

$A_{65}$=mass dispersion coefficient $A_x$=Image magnification in the x direction S=Width of the entrance gap in the x direction $\Delta$=Aberration in consequence of all image defects which are present.

In this arrangement, as is represented FIG. 6, x is the horizontal coordinate, which lies in the deflection direction.

As beam axis there is designated the path of a so-called reference particle, which possesses the desired mass and energy. The coordinate system is set in the path of this reference particle. Accordingly, the reference particle has at the entrance gap the initial coordinates:

$$x_0=y_0=\alpha_0=\beta_0=\delta_0=0$$

and at the exit gap the final coordinates:

$$x_1=y_1=\alpha_1=\beta_1=\delta_1=\gamma_1=0.$$

In these equations, as is evident from FIG. 6, the symbols used hereinabove have the following meanings:

$x_0$=half-width of the object gap $y_0$=half-height of the object gap $\alpha_0$=half aperture angle in the x direction (in the deflection plane)

$\beta_0$=half aperture angle in the y direction $\delta_0$=energy deviation with $\delta_0$=E/E $\gamma_0$=mass deviation with, $\gamma_0$ =m/m.

A charged particle, e.g. an ion, which enters the deflection system or the mass spectrometer from the entrance gap with specific initial coordinates (designated by the subscript 0) arrives at the exit gap with specific final coordinates (designated by the subscript 1). In this connection, the quantity of predominant interest is the final coordinate $x_1$, since this deviation in the x direction has a direct effect on the mass resolution. The final coordinate $x_1$ may be described by the following equation:

$$\begin{aligned} x_1 = {} & A_x \cdot x_0 + A_\alpha \cdot \alpha_0 + A_\delta \cdot \delta_0 + A_\gamma \cdot \gamma_0 + && \text{(1st order terms)} \\ & A_{\alpha\alpha} \cdot \alpha_0\, 2 + A_{\alpha\delta} \cdot \alpha_0\, \delta_0 + A_{\delta\delta} \cdot \delta_0^2 + \\ & A_{yy}\, y_0^2 + \\ & A_{y\beta} \cdot y_0\, \beta_0 + A_{\beta\beta}\beta_0^2 + && \text{(2nd order terms)} \\ & \text{higher order terms.} \end{aligned}$$

The various image defect coefficients are designated by the letter A and the corresponding subscript in these equations. In the formula for the mass resolution set forth hereinabove, the expression for $X_1$ corresponds to the term, designated by $\Delta$, for the aberration.

In a double focus mass spectrometer, there is a first order directional and energy focusing, so that the deflect coefficients are $A_\alpha = A_{67} = 0$.

$A_x$ is the magnification in the x direction, which is of the order of magnitude of one if the geometrical arrangements of the imaging system are normal.

$A_\gamma$ relates to the mass dispersion, which is desired in order to be able to separate differing masses.

The remaining indicated coefficients are second order image defect coefficients. Thus, in order to achieve the desired second order double focus, it is necessary in the imaging system to bring both the coefficient $A_{\alpha\alpha}$ for the directional focusing and also the coefficients $A_{\alpha\delta}$ and $A_{\delta\delta}$ for the energy focusing to the value 0, or at least to make them negligibly small.

OBJECTS AND SUMMARY OF INVENTION

The object of the invention is accordingly to indicate a lens arrangement with which the imaging of the particles in the imaging system or in a double-focus mass spectrometer is improved, more particularly for the compensation of the energy dispersion of the particles.

The solution according to the invention consists in designing a lens arrangement of the initially mentioned type in such a manner that the lens arrangement is situated at the location or at least in the vicinity of the intermediate image produced by the imaging system, and that the lens arrangement consists of a plurality of lens elements, which form a transmission channel for the particle beam and which are constructed of metal plates, sheets, rods or the like, which are disposed with their transmission apertures in alignment and which are disposed in succession in the direction of the beam and which are connected to adjustable electric voltages or currents.

In this arrangement, the lens arrangement can be constructed as a slit lens, tube lens, rotationally symmetric lens, ring focus lens, cylindrical lens, plate lens or rectangular tube lens with aligned transmission apertures forming the transmission channel, or as a quadrupole lens with rods laterally delimiting the transmission channel.

In a double-focus mass spectrometer according to the invention, such a lens arrangement is disposed between the sector field magnet and the electrostatic analyser at the location or at least in the vicinity of the intermediate image produced by the imaging system.

In an arrangement of this type, by appropriate setting of the electric voltages at the plates of the lens arrangement the desired focal length of the lens arrangement can be set, which ensures the influencing of the energy dispersion of the particle beam, without impairing in a disadvantageous manner the deflection of the particles which is undertaken by the imaging system. On this basis, the image defects caused by energy deviations may be compensated in a manner which is both simple and effective.

Expediently, the lens arrangement is disposed in the direction of the beam symmetrically in relation to the location or to the plane of the intermediate image. The outer plates of the lens arrangement in the direction of the beam are expediently at earth potential, while one or more inner plates disposed there between are at potentials differing therefrom. In such an arrangement, lens arrangements having one or two inner plates are particularly expedient for practical purposes. For ion acceleration voltages of approximately 3 kV, focusing voltages at the lens arrangement of the order of magnitude of approximately 1 kV prove to be expedient. Where two inner plates are provided, these do not need to be at equal potentials; indeed, by the application of differing potentials to the inner plates any possible inaccuracies of the geometry may be compensated, if for example the location of the intermediate image is not accurately between the two inner plates.

According to the invention, a lens arrangement which is particularly suitable for practical purposes is one with plates which are disposed so as to be equidistant and plane-parallel to one another at small spacings of the order of magnitude of a few millimetres, with slits aligned with one another, the slit height of which is substantially greater than the slit width. Such plates can advantageously be fitted on a common mounting, in which case they are fixed and insulated in relation to one another. In one embodiment, these comprise disc-shaped plates with a centrally disposed slit, and in another embodiment the plates are formed in each instance by semicircular surfaces. An aperture diaphragm and/or a quadrupole lens may be positioned behind the lens arrangement. While the slit lens compensates image defects in the x direction, more particularly energy deviations, and provides the second order energy focusing, focusing in the y directin may be undertaken by means of the quadrupole lens. The latter can possibly also be improved by a special embodiment of an electrostatic analyer, positioned behind, in the form of a toroid condenser.

Further advantageous refinements of the lens arrangement according to the invention, as well as of the mass spectrometer equipped therewith, are indicated in the subclaims and are evident from the exemplary embodiments explained.

BRIEF DESCRIPTION OF THE DRAWINGS

The invention is explained in greater detail herein below with reference to the description of such exemplary embodiments and with reference to the accompanying drawing. In the drawing.

DESCRIPTION OF THE PREFERRED EMBODIMENTS

Figure 1:
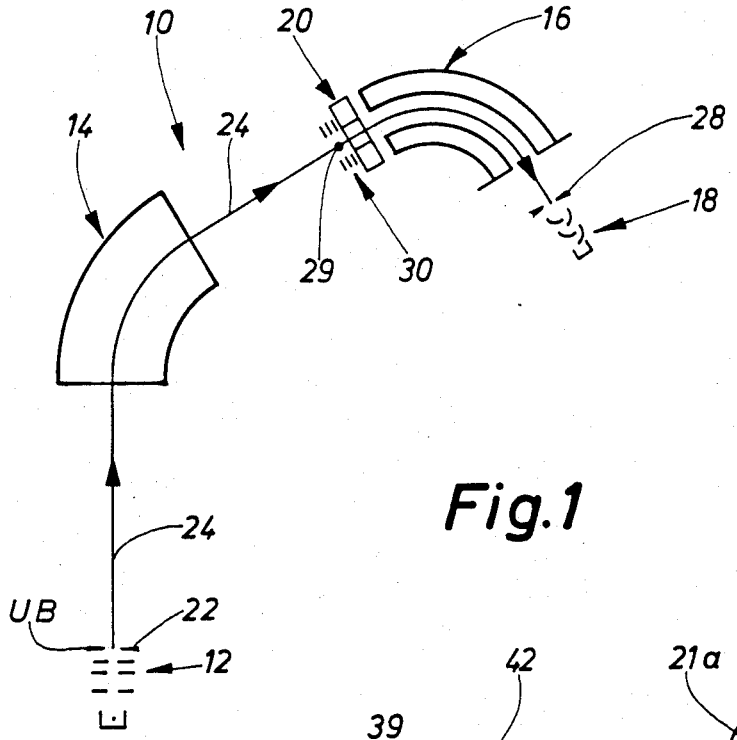
FIG. 1 shows a schematic representation of an embodiment of a mass spectrometer with the lens arrangement according to the invention.

FIG. 1 shows the general construction of a mass spectrometer 10, which in the direction of the beam of particles emerging from an ion source 12 exhibits an entrance gap 22, which is at an ion acceleration voltage UB, approximately a potential of a few kilovolts, for example three kV.

An emerging particle beam 24 passes in the first instance through a sector field magnet 14, and subsequently traverses a lens arrangement 30 at the location of the intermediate image 29, in the present embodiment a quadrupole lens 20 positioned behind, as well as an electrostatic analyser 16, and then passes through an exit gap 28 into an ion detector 18 for the examination of the respective particles. Such an ion detector 18 can be equipped, in the conventional manner, with a secondary electron multiplier. In another embodiment, which is not shown, the particle beam can also in the first instance pass through an electrostatic analyser and then a sector field magnet.

It is important in this connection that the lens arrangement 30 is situated at the location or at least in the vicinity of the intermediate image 29 produced by the imaging system. In this manner the lens arrangement 30 can execute the required focusing function and influence the particle beam coming from the sector field magnet 14, in order to ensure the desired second order energy focusing. In a lens arrangement with three plates according to FIGS. 2 and 3, the location of the intermediate image 29 is expediently in the transmission aperture or the slit at the height of the middle plate, while in the embodiment of the lens arrangement according to FIG. 4 the location of the intermediate image 29 is expediently between the two inner plates of the lens arrangement 30.

Figure 2:
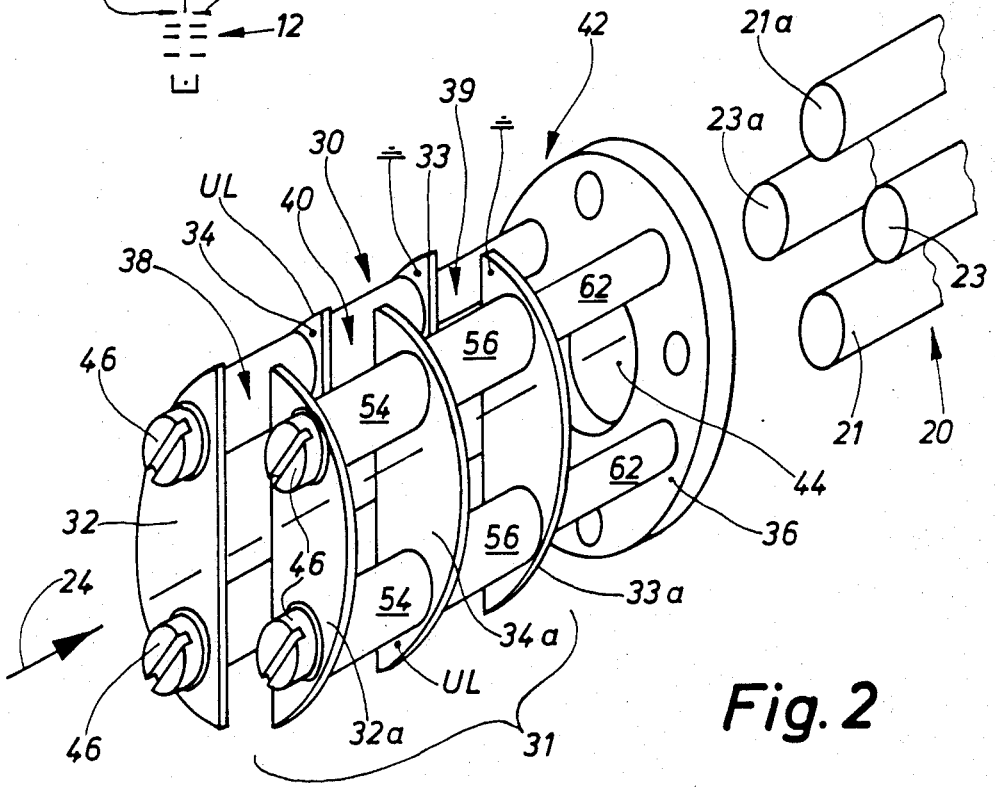
FIG. 2 shows a perspective representation of a first embodiment of the lens arrangement according to the invention.
Figure 3:
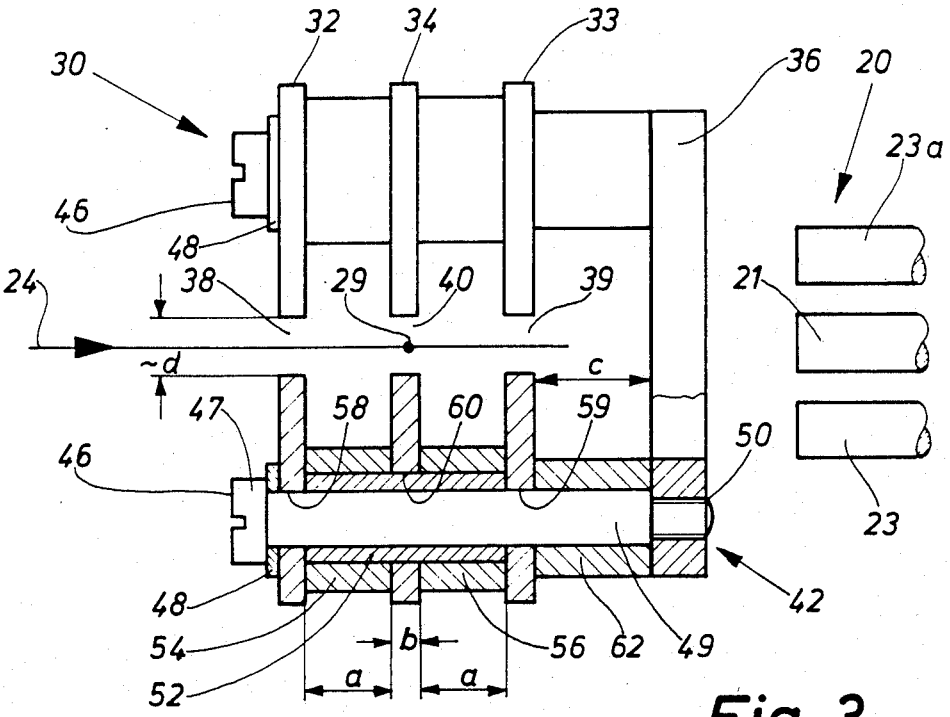
FIG. 3 shows a side elevation, partly in section, of the lens arrangement according to FIG. 2.
Figure 4:
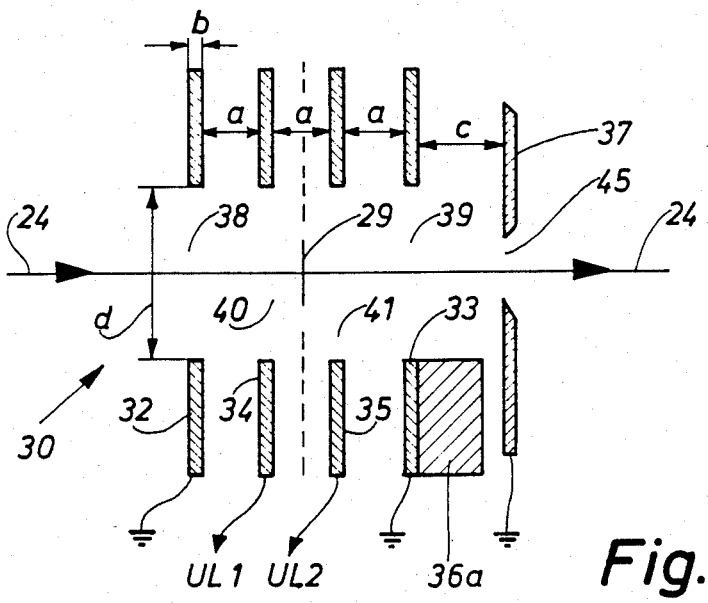
FIG. 4 shows a schematic side elevation of another embodiment of the lens arrangement according to the invention.

As indicated in FIGS. 2 to 4, the two outer plates 32 and 33 of the lens arrangement 30 are at earth potential, while a focusing voltage UL or focusing voltages UL1 and UL2 are applied to the inner plate 34 or the inner plates 34 and 35, so that the inner plates are at the desire potential. These potentials are a function of the intended magnitude of the focal length of the lens arrangement 30.

For practical purposes of application, these potentials of the inner plate or of the inner plates are of the order of magnitude of a few hundreds of volts to a few kilovolts, expediently of the order of magnitude of 1 to 2 kilovolts. The precise value of the focusing voltage is a function of the geometrical relationships of the imaging system, as well as of the ion acceleration voltages, at which operations take place in the system. At an ion acceleration voltage of three kilovolts, the inner plate 34 of a lens arrangement 30 with three plates can be for example at a focusing voltage, the value of which is one third of the ion acceleration voltage UB and more particularly amounts to $0.371 \times UB$.

Figure 5:
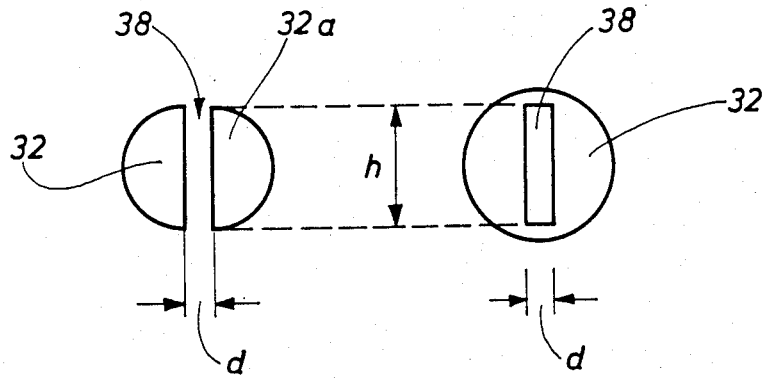
FIG. 5 shows a schematic front elevation of two embodiments of the plates for the lens arrangements according to the invention.
Figure 6:
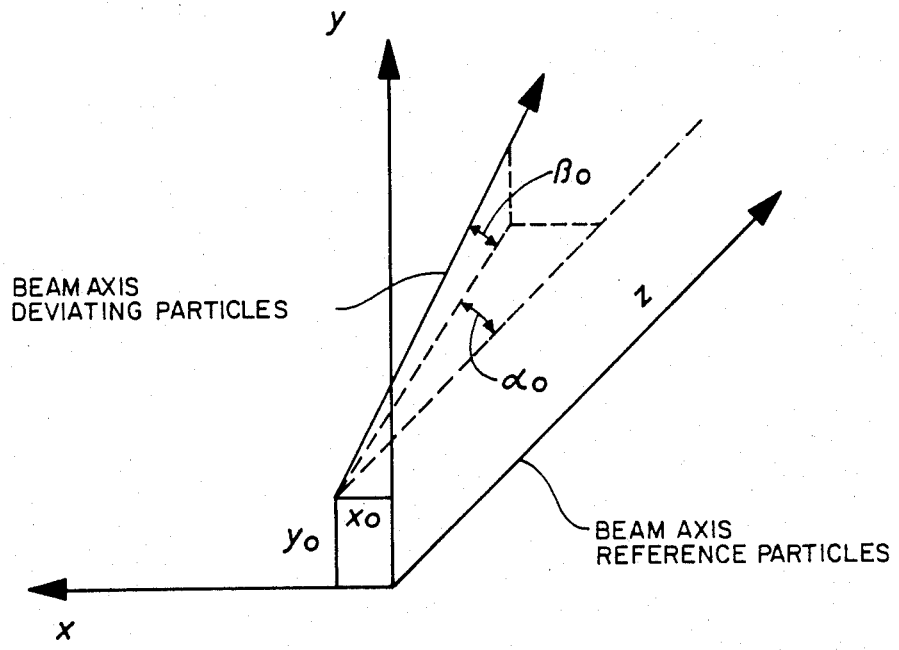
FIG. 6 shows a schematic reprsentation to explain the geometrical relationships in an imaging system for the particles to be examined.

As is schematically indicated in the drawing, the lens arrangement 30 is constructed as a slit lens 31 and has a plurality of plates, which are disposed in succession in the direction of the beam, with aligned slits, which stand substantially perpendicular to the beam direction of the particle beam 24 and to the deflection plane of the imaging system; in this arrangement, the individual plates are disposed parallel to one another. In this arrangement, as shown in FIGS. 3 and 4, the individual plates are expediently disposed so as to be equidistant and plane-parallel to one another. The spacing between the individual plates 32, 33, 34 and 35 of the slit lenses 31 is of the order of magnitude of a few millimeters. In the embodiment according to FIG. 3, this plate spacing a can have approximately the value of three millimeters; in the embodiment according to FIG. 4, the plate spacing a amounts to approximately two millimeters. The thickness b of the individual plates is substantially smaller than the plate spacing a. It proves to be expedient to select a thickness b of the order of magnitude of approximately 0.5 millimeter. The gap width or slit width d is of the order of magnitude of a few millimeters, and has for example a value of six millimeters in practical embodiments. The gap height h indicated schematically in FIG. 5 is again substantially greater than the gap width d. The slit height h should at least be of the order of magnitude of thirty millimeters or more, especially in circumstances in which an embodiment of the slit which is bouned on all sides is involved, as shown in the righthand illustration in FIG. 5.

In the beam direction behind the actual lens arrangement 30, an aperture diaphragm can be provided, for example in the form of a separate aperture diaphragm 37 with a transmission aperture 45 according to FIG. 4 or in the form of a mounting plate 36 with a transmission aperture 44 according to FIG. 2. The diaphragm spacing c is likewise of the order of magnitude of a few millimeters, and is expediently somewhat greater than the respectively selected equidistant plate spacing a. In the embodiment according to FIG. 3, the diaphragm spacing amounts to approximately four millimeters; in the embodiment according to FIG. 4, it amounts to approximately three millmeters.

A first embodiment of the lens arrangement 30 is shown in FIG. 2 and FIG. 3. The individual plates 32, 33 and 34 are fitted at the mounting plate 36 with a common mounting 42. The securing of this mounting 42 in the imaging system is not shown, for reasons of simplicity. The three plates 32, 33 and 34 disposed in succession form the slit lens 31 together with the opposite plates **32*a*, 33*a* and 34*a* which are aligned with them. As can most clearly be seen from FIG. 2, the plates 32, 32*a*, 33, 33*a*, 34 and 34*a* are constructed with the shape of an approximately semicircular surface, and are disposed at predetermined spacings from one another in the axial and radial direction, in such a manner that both the radial spacings and the axial spacings are equidistant. The slits 38, 39 and 40 are thus formed between them; these slits are aligned with one another and leave the path clear for the particle beam 24**.

In the mounting plate 36, bolts 46 extending parallel to the direction of the axis are screwed by a thread 50 into the mounting plate 36. The respective bolt shank 49 passes through passage openings 58, 59 and 60 of the plates 32, **32*a*, 33, 33*a*, 34 and 34*a*. On to the bolt shank 49 of the respective bolt 46 there are further pressed a metal tube 62 and an insulating tube 52, which retain the plates 32 and 33 as well as the plate 33 and the mounting plate 36 at predetermined axial spacings. Furthermore, further annular or sleeve-shaped insulating tubes 54 and 56 are pressed onto the insulating tube 52, which is constructed so as to be annular or sleeve-shaped, as is schematically represented in FIG. 3**.

The bolt 46 abuts by a disc 48 against one outer plate 32 of the lens arrangement 30, as is shown in FIG. 3.

In such an arrangement according to FIGS. 2 and 3, the insulating tubes 54 and 56 hold the plates 32, 33 and 34 at a predetermined spacing from one another, while the inner insulating tube 52 provides the axial fixing of the outer plates 32 and 33 as well as the radial fixing of the inner plate 34, in such a manner that the inner plate 34 is disposed so as to be electrically insulated from the outer plates 32 and 33. In this arrangement, the diameter of the passage bore 60 is adapted to the external diameter of the insulating tube 52, so that perfect fixing is obtained.

The metal tube 62 provides, on the one hand, the fixing of the outer plate 33 relative to the mounting plate 36; at the same time, an electrically conductive connnection is provided thereby, so that the outer plate 33 and the mounting plate 36 are at the same potential, namely earth potential. In this manner, the mounting plate 36 can carry out the function of an aperture diaphragm with a transmission aperture 44, the diameter of the transmission aperture being appropriately selected.

The embodiment according to FIG. 4 substantially corresponds to the above described embodiment according to FIGS. 2 and 3, with the difference that the embodiment according to FIG. 4 shows an arrangement with four plates. In this case also, the plates 32, 33, 34 and 35 have equidistant spacings from one another, namely a plate spacing a, the plates being provided plane-parallel to one another. The outer plates 32 and 33 are at earth potential, while the two inner plates 34 and 35 are connected to focusing voltages UL 1 and UL 2 respectively, in order to bring them to a suitable focusing potential. The plate 35 thus forms a slit 41, which has the same dimensions as the other slits 38, 39 and 40. The location of the intermediate image 29 is situated between the two inner plates 34 and 35 in this embodiment.

In the embodiment according to FIG. 4, the individual parts of the mounting have not been shown in detail, for the sake of simplicity. In this arrangement, an appropriate mounting can be used, such as that shown in FIGS. 2 and 3 of the drawing. As a variation of the described design, the plate 33 situated at the exit of the lens arrangement 30 in the direction of the beam can be constructed with a reinforced or widened portion 36*a*, which is indicated only schematically. In this manner, the additional mounting plate 36 of the embodiment according to FIGS. 2 and 3 can be dispensed with. The bolts 46 can then be screwed directly into the body of the widened portion 36*a*. The aperture diaphragm 37, provided separately therefrom, with the transmission aperture 45 can be constructed so as to be adjustable in the direction of the beam.

The spacers and insulating tubes are also not shown in FIG. 4, for reasons of simplicity. Such insulating tubes or insulating sleeves expediently consist of ceramic material, for example of aluminium oxide, while the plates forming the lens arrangement 30 consist of metal.

As is schematically indicated in FIGS. 1 to 3, a quadrupole lens 20 can be positioned behind the lens arrangement 30. In FIG. 2 and FIG. 3, it is possible to see electrodes 21 and 21*a* vertically aligned with the slits 38, 39 and 40, as well as horizontally aligned electrodes 23 and 23*a*, disposed symetrically in relation to the axis of the particle beam 24. The voltage supply for the quadrupole lens 20 is not shown in detail; voltages of the order of magnitude of for example ten to twenty volts are applied to the pairs of electrodes. Such a quadrupole lens 20 serves for example to improve the focusing in the y direction. Additionally or alternatively thereto, the electrostatic analyser 16 positioned behind can be constructed as a toroid condenser.

Although not specifically represented in the drawing, the lens arrangement 30 can also be replaced by two partial lenses, which are disposed symmetrically in relation to the location of the intermediate image 29 in the direction of the beam. In this arrangement, the two partial lenses are expediently constructed symmetrically, and each one of them has approximately one half of the refractive power of the entire lens arrangement 30. Expediently, each partial lens in this arrangement has its own, separate voltage supply.

Such separate voltage supplies for the respective inner plates of the lens arrangement serve to compensate for any possible inaccuracies of the geometry of the imaging system. Thus, if the lens arrangement 30 is not situated precisely at the location of the intermediate image 29, a correction can be made by the application of differing voltages to the inner plates, so that the desired second order image defect correction can actually be achieved. Proceeding from empirical values for the focusing potentials, the accurate values are then to be determined experimentally.

In an exemplary embodiment with an ion acceleration voltage UB of three kilovolts and a lens arrangement 30 having three plates 32, 33 and 34 at a spacing of three millimeters in each instance, the potential at the central plate 34 had a value of $0.371 \times UB$, which gave a focal length in the x direction of $fx=0.2746$ meter. While the coefficients of the second order energydependent image defects without the application of the lens arrangement 30 had the values $A_{\alpha\delta}=0.87$ and $A_{\delta\delta}=-0.56$, with the lens arrangement according to the invention at the location of the intermediate image these coefficients could be compensated virtually entirely, so that the values $A_{\alpha\delta}=0$ and $A_{\delta\delta}=0.0017$ were obtained.

It should be pointed out that image defects of the lens arrangement 30 itself are virtually insignificant. It should simply be borne in mind that not the full aperture of the lens arrangement 30 is used, but for example up to one third of this lens aperture.

In those embodiments in which the plates consist of opposite plate pairs or plate halves, the same voltage should of course be applied to each plate half of a pair. This is schematically indicated in FIG. 2, where the plate halves 34 and 34*a* are both respectively connected to the focusing voltage UL. Corresponding considerations apply to embodiments with a larger number of plates.

The invention is of course not restricted to the slit lenses described in detail; indeed, the most widely varying types of lenses can be employed for the lens arrangement at the location of the intermediate image, e.g. lens arrangements consisting of rectangular or cylindrical tube lenses, ring focus lenses, rotationally symmetric lenses, plate lenses or quadrupole lenses. In such cases, the statements appearing above concerning the arrangement and the electrical supply for the individual plates respectively are applicable mutatis mutandis to the individual lens elements of the lens arrangement.

I claim:

1. Double focusing mass spectrometer comprising an ion source, an imaging system having a sector field magnet and an electrostatic analyzer with a detector positioned downstream with respect to a particle beam, the latter for particles of organic and inorganic substances to be examined, said imaging system providing a deviation in a predetermined direction of a particle, said deviation being subject to abberration due to image defects which are present, said defects including first and second order directional and energy focusing terms, the system further comprising a lens means disposed between said sector field magnet and said electrostatic analyzer at the location of the intermediate image produced by said imaging system for making negligible only said second order terms but not affecting said first order terms, said lens means being further disposed substantially symmetrically relative to said location of said intermediate image, said lens means comprising a plurality of lens elements, which form a transmission channel for a particle beam, said lens elements being disposed with transmission apertures thereof in alignment and being disposed in succession in the direction of the beam and being connected to an adjustable source of electric energy.

2. Double focusing mass spectrometer according to claim 1 in which the lens arrangement comprises slit lenses.

3. Double focusing mass spectrometer according to claim 1 in which the lens elements are formed by at least three plates, which are disposed in succession at intervals and of which two outer plates are at a first potential, while inner plates situated therebetween have a potential differing therefrom.

4. Double focusing mass spectrometer according to claim 1 in which said two outer plates are at ground potential.

5. Double focusing mass sepctrometer according to claim 3 in which said inner plates are at potentials of approximately 1 to 2 kV.

6. Double focusing mass spectrometer according to claim 1 where said particle beam includes charged particles and said mass spectrometer includes means for providing an accelerating voltage for said particles in which said lens arrangement comprises three plates in which the inner plate is at a potential which constitutes approximately one-third of the value of the accelerating voltage of the charged particles.

7. Double focusing mass spectrometer according to claim 1 in which said lens elements are disposed with the transmission apertures substantially perpendicular to the direction of the ion beam and to the deflection plane of the imaging system and are disposed parallel to one another.

8. Double focusing mass spectrometer according to claim 7 in which the plates are disposed so as to be equidistant and plane-parallel to one another.

9. Double focusing mass spectrometer according to claim 7 in which a spacing between the individual plates is approximately 2 to 3 mm, and the thickness of the plates which has a value of approximately 0.5 mm is substantially smaller than the plate spacing.

10. Double focusing mass spectrometer according to claim 1 in which the lens elements are fitted to a common mounting and are electrically insulated from one another and secured against axial and radial displacements.

11. Double focusing mass spectrometer according to claim 10 in which the mounting comprises a mounting plate which is provided with a transmission aperture and at which a plurality of bolts is fitted substantially in parallel to the direction of the ion-beam, which bolts hold the plates at a spacing from one another.

12. Double focusing mass spectrometer according to claim 10 in which the lens elements are formed by plates with through bores which are held by the mounting and in which the outer plates are maintained at a spacing by a first, annular insulating tube, and in which the respective inner plates are maintained at a spacing by a second annular insulating tube, and in which the respective inner plates are maintained at a spacing from one another and from the outer plates by third annular insulating tubes pressed onto the second insulating tube.

13. Double focusing mass spectrometer according to claim 11 in which the lens element disposed on the downstream side of the ion beam is electrically conductively connected with the mounting plate by a metal tube and in which the transmission aperture of the mounting plate forms an exit aperture which is adjustable in the direction of the beam.

14. Double focusing mass spectrometer according to claim 1 in which the lens element disposed at the exit in the direction of the beam is constructed to be strengthened and at the same time forms a mounting plate, a displaceable aperture diaphragm being positioned downstream the lens arrangement.

15. Double focusing mass spectrometer according to claim 12 in which the insulating tubes for the mutual fixing of the plates consist of ceramic material, more particularly of aluminum oxide, while the plates themselves are constructed of metal.

16. Double focusing mass spectrometer according to claim 1 in which the lens elements are constructed as circular discs, each having in the center of longitudinal slit, the height of which is substantially greater than its width.

17. Double focusing mass spectrometer according to claim 1 in which the lens elements consist of two-part circular discs, which leave free between them a longitudinal slit, the height of which is substantially greater than its width.

18. Double focusing mass spectrometer according to one of claims 16 or 17 in which the slit width is approximately 6 mm, while the slit height is at least 30 mm.

19. Double focusing mass spectrometer according to claim 1 comprising a quadrupole lens positioned downstream of said lens arrangement.

20. Double focusing mass spectrometer according to claim 19 in which the quadrupole lens has an aperture radius of approximately 7.5 cm and a length of approximately 3 cm and in which opposite electrode pairs are at potentials of approximaely 10 to 20 volts for ion energies of 3 kV, the electrodes aligned perpendicular to the deflection plane and the two electrodes disposed in the deflection plane having, in pairs, equal potential of opposite polarity.

21. Double focusing mass spectrometer according to claim 1 in which a pair of partial slit lenses is disposed in a symmetrical relation to the location or to the plane of the intermediate image in the direction of the beam, each of said partial slit lenses having approximately onehalf of the refractive power of the entire lens arrangement.

22. Double focusing mass spectrometer according to claim 21 in which each of said pairs of partial slit lenses is connected to separate voltage supply.

23. Double focusing mass spectrometer according to claim 1 in which a toroid condenser is positioned downstream from the lens arrangement for forming an electrostatic analyzer.

24. Double focusing mass spectrometer according to claim 1 in which the lens elements comprise metal plates.

25. Double focusing mass spectrometer according to claim 1 in which the lens elements comprise metal sheets.

* * * * *